US010660434B2

(12) United States Patent
Uffmann

(10) Patent No.: US 10,660,434 B2
(45) Date of Patent: May 26, 2020

(54) LIFTING HARDWARE

(71) Applicant: NINKAPLAST GMBH, Bad Salzuflen (DE)

(72) Inventor: Axel Uffmann, Melle (DE)

(73) Assignee: Ninkaplast GmbH, Bad Salzuflen (DE)

( * ) Notice: Subject to any disclaimer, the term of this patent is extended or adjusted under 35 U.S.C. 154(b) by 0 days.

(21) Appl. No.: 16/467,167

(22) PCT Filed: Nov. 27, 2017

(86) PCT No.: PCT/EP2017/080520

§ 371 (c)(1),
(2) Date: Jun. 6, 2019

(87) PCT Pub. No.: WO2018/114235

PCT Pub. Date: Jun. 28, 2018

(65) Prior Publication Data

US 2019/0313791 A1 Oct. 17, 2019

(30) Foreign Application Priority Data

Dec. 20, 2016 (DE) ..... 20 2016 107 168 U

(51) Int. Cl.
*A47B 51/00* (2006.01)
*A47B 77/16* (2006.01)
*A47B 77/10* (2006.01)

(52) U.S. Cl.
CPC ..... *A47B 51/00* (2013.01); *A47B 77/16* (2013.01); *A47B 77/10* (2013.01)

(58) Field of Classification Search
CPC ... A47B 21/0073; A47B 13/081; A47B 17/02; A47B 51/00; A47B 77/04; A47B 77/10;
(Continued)

(56) References Cited

U.S. PATENT DOCUMENTS 2,861,857 A 11/1958 Lee et al.
2,875,012 A * 2/1959 Riley ..... A47B 51/00 312/312

(Continued)

FOREIGN PATENT DOCUMENTS

DE 2435720 A1 * 2/1975 ..... A47B 87/02
DE 19812959 A1 * 9/1999 ..... A47B 51/00

(Continued)

OTHER PUBLICATIONS

Translated Description DE202008006543U1, 10 pages (Year: 2009).*

*Primary Examiner* — Andrew M Roersma
(74) *Attorney, Agent, or Firm* — Richard M. Goldberg

(57) ABSTRACT

Lifting hardware for a base which can be lowered into an opening of a work surface, includes a support frame which holds the base and is adjustable vertically relative to the work surface by a drive, the exterior periphery of the support frame is arranged at a distance from edges of the opening in the horizontal direction; the base rests loosely on the support frame in the vertical direction and is held thereon in a form-fitting manner in the horizontal direction by four engagement structures which form corners of a rectangle, each having a vertically oriented web on the support frame or base, and a complementary plug-in slot on the other and fixes the position of the support frame and base only in the horizontal direction normal to the web; and the plug-in slots are oriented at right angles to one another for each pair of mutually adjacent engagement structures.

8 Claims, 3 Drawing Sheets

(58) Field of Classification Search
CPC ..... A47B 77/16; A47B 81/064; A47B 46/00; A47B 46/005; A47B 2220/0013; A47B 9/04; A47B 96/066; A47B 96/06; A47B 87/02; A47B 87/0276
See application file for complete search history.

(56) References Cited

U.S. PATENT DOCUMENTS

| | | | | | |
|---|---|---|---|---|---|
| 3,361,510 | A * | 1/1968 | McDermott | ..... | A47B 51/00 312/312 |
| 4,050,386 | A * | 9/1977 | Kellogg | ..... | A47B 47/024 108/190 |
| 4,577,821 | A * | 3/1986 | Edmo | ..... | B66F 7/08 108/145 |
| 5,694,864 | A * | 12/1997 | Langewellpott | ..... | B66F 7/0608 108/145 |
| 7,410,226 | B1 | 8/2008 | Meskan | | |
| 2011/0155867 | A1 | 6/2011 | Griepentrog | | |

FOREIGN PATENT DOCUMENTS

| | | | | | |
|---|---|---|---|---|---|
| DE | 202008006543 | U1 | 9/2009 | | |
| DE | 202012101785 | U1 | 6/2012 | | |
| DE | 102012009995 | A1 | 11/2013 | | |
| GB | 2195879 | A * | 4/1988 | ..... | A47B 51/00 |
| WO | 2005/118456 | A1 | 12/2005 | | |

* cited by examiner

LIFTING HARDWARE

BACKGROUND OF THE INVENTION

The invention relates to a lifting hardware for a base which can be lowered into an opening of a work surface, comprising a support frame which holds the base and can be adjusted vertically relative to the work surface by means of a drive.

Lifting hardware of this type is used for example in kitchen corner cabinets and may have one or more bases which are arranged one upon the other in a shelf configuration, the bases being provided for disposing objects which, in this way, can be accommodated in the interior of the corner cabinet which is difficult to access, by lowering the bases through the work surface into the corner cabinet by means of the lifting hardware.

Since the base fills the opening of the work surface almost completely, contusions are likely to occur if someone reaches with her hand into the opening of the work surface while the base is lowered to the level of the work surface. For this case, it is known to provide an emergency stop circuit which disables the drive when, while the lifting hardware is lowered, the resistance to overcome exceeds a certain value.

SUMMARY OF THE INVENTION

It is an object of the invention to provide a lifting hardware with improved safety.

According to the invention, this object is achieved by the feature that the exterior periphery of the support frame is arranged at a distance from the edges of the opening of the work surface in the horizontal direction; the base rests loosely on the support frame in vertical direction and is held on the support frame in the horizontal direction in a form-fitting manner by four engagement structures which form the corners of a rectangle; each engagement structure has a vertically oriented web on one of the support frame and the base, and a complementary plug-in slot on the other of the support frame and the base and fixes the relative position of the support frame and the base only in the horizontal direction normal to the web; and the plug-in slots are oriented at right angles to one another for each pair of mutually adjacent engagement structures.

The invention provides a mechanical self-acting contusion guard, because, due to the inwardly offset arrangement of the support frame, there occurs only a shear movement between the base and the edge of the opening of the work surface, but the base can be lifted upward with almost no resistance. Nevertheless, the engagement structures assure that the base is fixed on the support frame in a form-fitting manner in each direction in the horizontal plane.

If someone reaches into the opening of the work surface and the base is thereby lifted on one side while the lifting hardware is lowered, at least one of the plug-in slots on the opposite side is oriented in parallel with the side of the base that has been lifted, and this plug-in slot and the web engaging therein define a tilt axis about which the base can be tilted.

The dependent claims specify useful details of the invention which achieve an improvement in safety as well as an exact alignment of the base in vertical and horizontal direction.

BRIEF DESCRIPTION OF THE DRAWINGS

An embodiment example will now be described in conjunction with the drawings, wherein.

DETAILED DESCRIPTION

Figure 1:
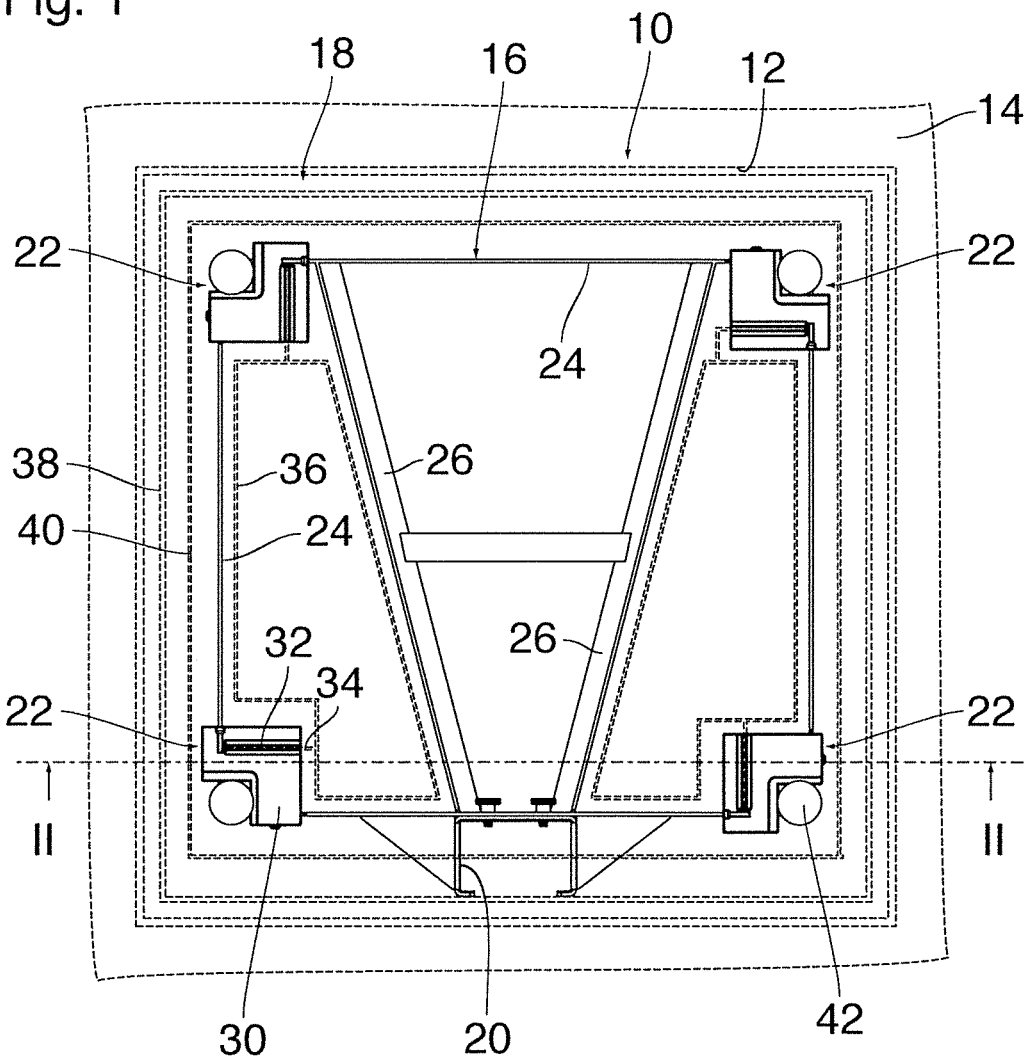
FIG. 1 is a top-plan view of a lifting hardware according to the invention.

FIG. 1 shows a lifting hardware 10 which, in a plan view, is arranged in an opening 12 of a work surface 14, e.g. a kitchen worktop, which extends over a plurality of floor cupboards. The opening 12 and the lifting hardware are then arranged above and in a corner cabinet, respectively.

The lifting hardware 10 has a support frame 16 which supports a base 18 which, in the example shown, has an approximately quadratic shape and fills the opening 12 almost completely when the base 18 and the work surface 14 are level with one another.

On one side, the support frame has a bracket 20 with which it is mounted on a vertical column 21 (not shown here but in FIG. 6), which can be adjusted in height by means of a motor drive 21*a*. The base 18, which has been shown in phantom lines in FIG. 1, forms the topmost base of the lifting hardware and completely covers the column 21 and the bracket 20. Further below, there may be corresponding support frames and bases (FIG. 6) in which, however, the base is recessed at the position of the respective bracket 20, so that the column may pass through the base with some play.

The base 18 is held on the support frame by means of four engagement structures 22 which form the corners of a rectangle and are arranged at the corners of the support frame and the base in this example. The outer periphery of the support frame is formed by four legs 24 that are connected to one another at the corners of the frame and are in this case configured as flat bars in an upright configuration. Internally, the support frame is stiffened by struts 26 that converge in a V configuration towards the position of the bracket 20. Each of the engagement structures 22 has a support 30 which has an approximately L-shaped contour and is plugged with the free end of one of its arms onto one of the legs 24 that converge at the corresponding corner, the support being also supported on the leg that extends at right angles to said one leg. In its horizontal top surface, the support forms a straight plug-in slot 32, and a web 34 formed at the bottom side of the base 18 engages in this plug-in slot. In this way, the horizontal position of the base 18 in the corner in consideration is fixed in the direction normal to the plug-in slot 32 and the web 34.

The four engagement structures have an identical design but are arranged in positions respectively rotated by 90°, so that the plug-in slots 32 of two engagement structures 22 which are not arranged diagonally to one another but are adjacent to one another on the same side of the base and the support frame extend at right angles to one another. As a whole, the position of the base 18 is thereby fixed in the horizontal plane in both translational degrees of freedom and in the rotational degree of freedom (rotation about the vertical axis).

The legs 24 of the support frame have a considerable distance in horizontal direction from the edge of the opening 12 of the work surface, whereby the risk of contusions between the work surface and the support frame is reduced to practically zero. If someone reaches into the opening 12 of the work surface with her hand while the support frame and the base are lowered, and one side of the base hits the hand, the base 18 can easily be lifted upwards from the support frame. In general, this will cause the base to tilt about an axis that is defined by one of the two plug-in slots on the opposite side of the base. Because of the large spacing between the lifted side of the base and the web 34 that is received in the plug-in slot that forms the tilt axis, the web 34 performs only a very small pivotal movement in the direction normal to the plug-in slot. For this reason, the web needs to have only little play, if any, in the plug-in slot. In the example shown here, the support 30 is formed by a plastic member in which the walls of the plug-in slot have a certain elasticity, so that they can receive the web 34 without play and nevertheless permit a pivotal movement of the base.

At least the bottom side of the base 18 is formed by a plastic member which, in addition to the webs 34 mentioned already, has further webs 36 which reinforce the structure and of which only some have been shown here. Other webs on the bottom side of the base form a peripheral outer frame 38 and, further inwardly, a peripheral inner frame 40. However, even the inner frame 40 is still outside of the support frame 16.

When the base 18 rests on the engagement structures 22, the position of the base in the vertical direction is not determined by the webs 34 and the plug-in slots 32 but instead by height-adjustable support plates 42 that are arranged at the inner corners of the support frame 16 and are embraced by the L-shaped support 30. By means of the support plates 42, the vertical position of the base 18 may be adjusted at all four corners such that the base is aligned exactly in parallel with the plane of the work surface 14.

Figure 2:
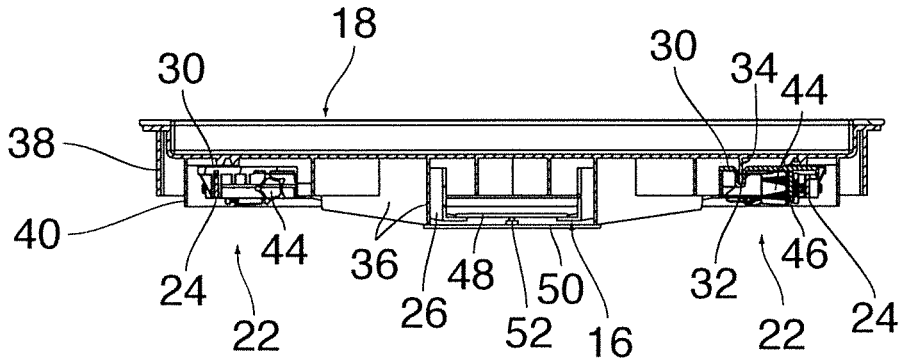
FIG. 2 is a sectional view taken along the line II-II in FIG. 1.
Figure 3:
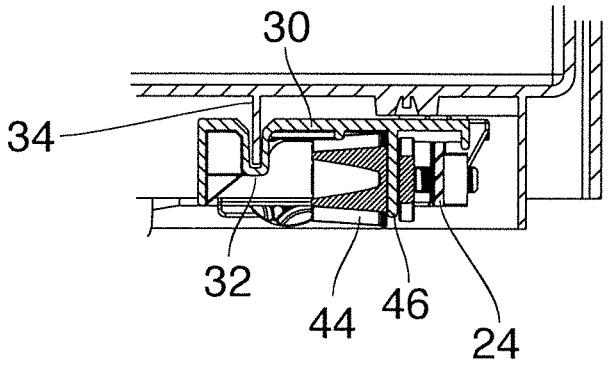
FIG. 3 shows a detail of FIG. 2.

In the sectional view shown in FIG. 2, in the engagement structure 22 on the right side, which has been shown on an enlarged scale in FIG. 3, the sectional plane passes through the plug-in slot 32 and the web 34 engaged therein. Below the support 30 there is provided a horizontally oriented adjustment screw 44 having a threaded portion screwed into an internally threaded bore of the leg 24 of the support frame. At its outer periphery, the adjustment screw 44 has a peripheral groove into which engages a flange 46 that projects downwardly from the support 30. The flange 46 has a U-shaped recess which opens downwardly and the edge of which engages in the peripheral groove of the adjustment screw 44. When the adjustment screw 44 is rotated, its axial position changes in the direction normal to the plug-in slot 32. The support 30 participates in this movement because it rests only loosely on the leg 24 which has been shown in cross-section in FIG. 3 and the support is slidable on the leg that extends at right angles thereto and onto which it is plugged-on. Thus, the position of the plug-in slot 32 and, accordingly, the position of the web 34 in the respective corner of the base 18 can be adjusted by means of the adjustment screw 44. Together, the adjustment screws 44 of the four engagement structures 22 permit to adjust the base 18 in all degrees of freedom of movement in the horizontal plane. In particular, the base 18 can be adjusted such that its edges extend exactly in parallel with the edges of the opening 12 of the work surface.

In the sectional view in FIG. 2, it can also be seen that the inner frame 40 formed at the bottom side of the base 18 projects downwardly beyond the outer periphery of the support frame 16 that is defined by the frame legs 24. If someone reaches into the opening 12 so far that she could touch the support frame 16, she would therefore touch the inner frame 40 first, which causes the base 18 to be lifted-off from the corresponding side of the support frame. Regardless of the position at which the inner frame 40 comes into contact with a part of the body of a user, the base 18 will also be lifted relative to the support frame 16 in its central area. En this area, as is shown in FIG. 2, the two struts 26 of the support frame are interconnected by a cross-bar 48. Two webs 36 of the base 18, which project downwards even further, are interconnected at this position by another cross-bar 50, and disposed between the two cross-bars 48 and 50 is a switch 52 which detects already a minute lifting movement of the base 18 relative to the support frame 16 and thereupon shuts down the drive of the lifting hardware, so that the support frame 16 will not be lowered further. In this way, contusions can be avoided even if someone reaches extremely far into the opening 12 of the work surface.

Figure 4:
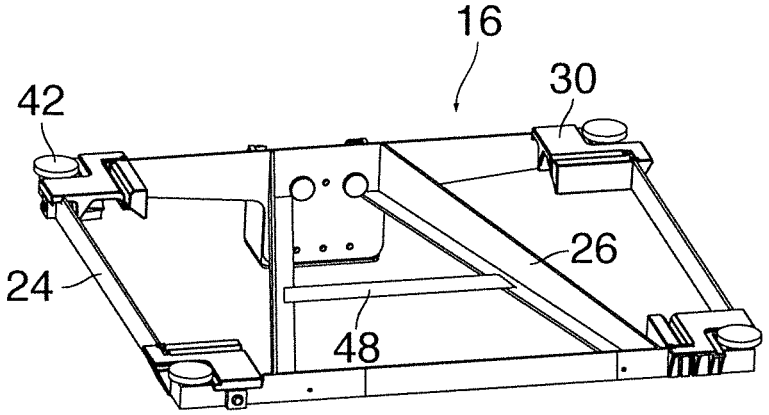
FIG. 4 is a perspective view of a support frame of the lifting hardware.
Figure 5:
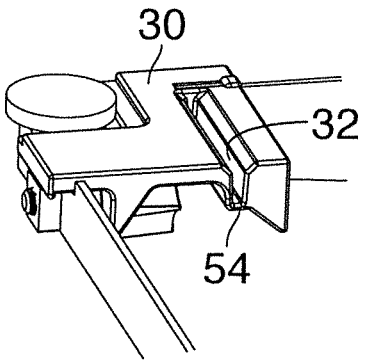
FIG. 5 shows a detail of FIG. 4.

In FIG. 4, the support frame 16 has been shown in a perspective view, but without the base 18. In particular, the arrangement of the supports 30 is visible here. One of these supports has been shown on an enlarged scale in FIG. 5. It can be seen that the vertical walls of the plug-in slot 32 form, at their top edge, guide chamfers for the web 34, and, at the bottom of the plug-in slot, these walls are only connected by a relatively thin elastic web 54 that is deformable in a bending mode. When the base 18 is lifted for example on the right side in FIG. 4 and consequently tilts about an axis that is defined by the plug-in slot 32 that has been shown at an enlarged scale in FIG. 5, this plug-in slot 32 can deform elastically and can therefore comply with the slight tilting movement of the web 34 engaging in this slot. In this way, the base 18 is fixed on the support frame 16 with extremely little play or even no play, and nevertheless the base can easily be tilted and lifted.

Figure 6:
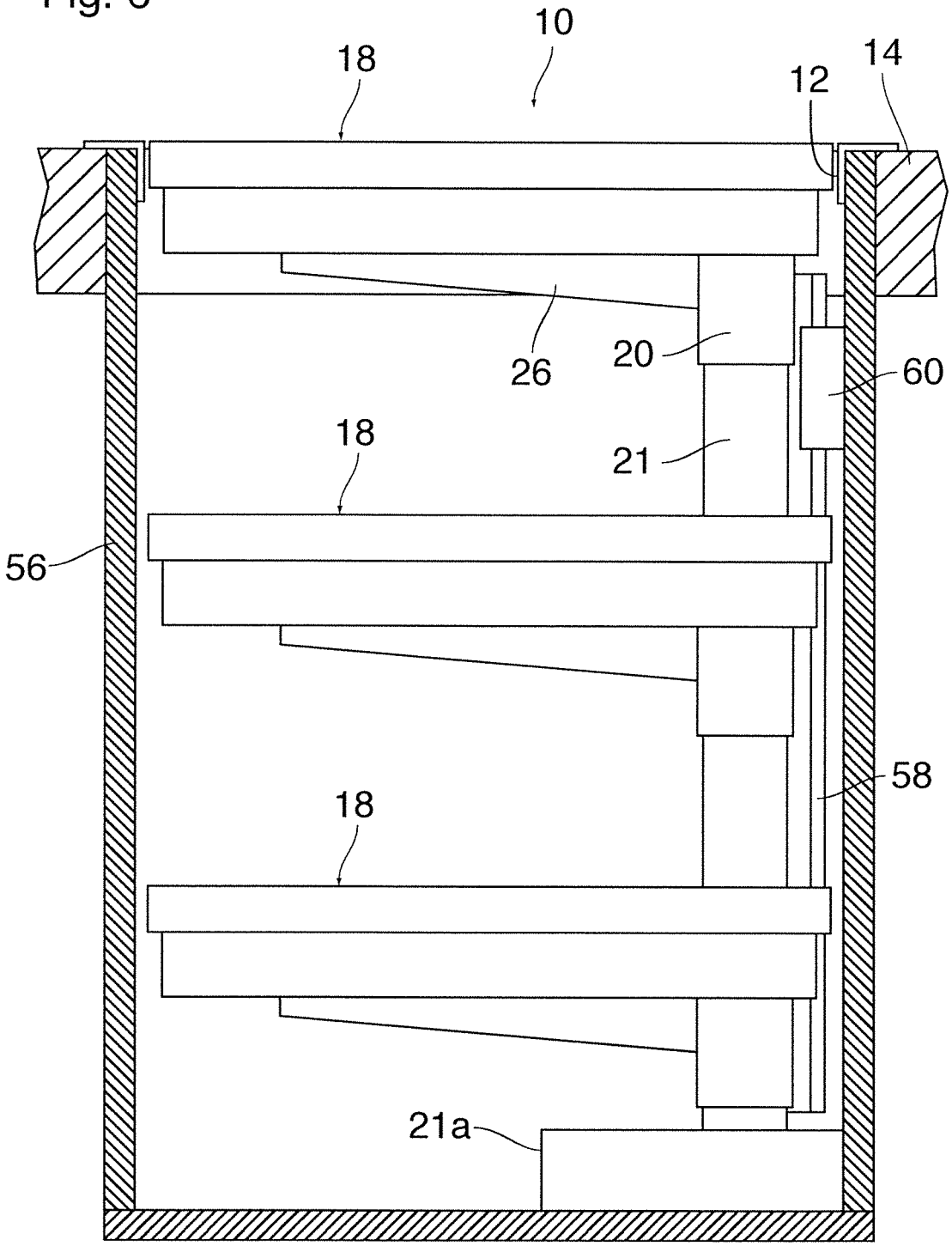
FIG. 6 is a vertical sectional view of the entire lifting hardware.

As is shown in FIG. 6, the entire lifting hardware 10 is accommodated in a chute-shaped housing 56 that is integrated in the work surface 14, with the motor drive 21*a* for the column 21 being arranged at the bottom of this housing. The column has, at its outer side, a T-shaped guide profile 58 that passes slidably through a holder 60 that is fixed at a side wall of the housing 56 in an upper part of this housing.

The engagement of the guide profile in the holder 60 prevents the column 21 from tilting (to the left side in FIG. 6) even when the column has been extended upwards to a relatively large degree.

What is claimed is:

1. A lifting hardware comprising:

a base which can be lowered into an opening of a work surface;

a support frame which holds the base and is adapted to be adjusted vertically relative to the work surface by a drive, the support frame having an exterior periphery configured to be arranged at a distance from edges of the opening of the work surface in a horizontal direction, and the base rests loosely on the support frame in a vertical direction; and four engagement structures which form corners of a rectangle and which hold the base on the support frame in a form-fitting manner in the horizontal direction, each said engagement structure having a vertically oriented web on one of the support frame and the base, and a complementary plug-in slot on the other of the support frame and the base and which fixes a relative position of the support frame and the base only in the horizontal direction and normal to the web, and the plug-in slots are oriented at right angles to one another for each pair of mutually adjacent said engagement structures, wherein each pair of one said web and one said plug-in slot defines a tilt axis about which the base is adapted to tilt.

2. The lifting hardware according to claim 1, wherein the support frame and the base each have a rectangular contour, and the engagement structures are arranged in the corners of said rectangular contour.

3. The lifting hardware according to claim 1, wherein the support frame includes a plurality of legs and each said engagement structure has a support that is plugged onto at least one respective said leg of the support frame and forms the plug-in slot.

4. The lifting hardware according to claim 1, wherein each said plug-in slot is formed by a member of which parts that define walls of the plug-in slot are elastically deflectable about a horizontal axis.

5. The lifting hardware according to claim 1, wherein the base has a peripheral frame extending outside of the support frame and projecting downwardly beyond the support frame, and further comprising a switch for detecting a lift-off movement of the base from the support frame and adapted to control the drive such that a downward movement of the lifting hardware is stopped.

6. The lifting hardware according to claim 1, further comprising height-adjustable support plates which support the base on the support frame in the vertical direction.

7. The lifting hardware according to claim 1, wherein each said engagement structure has an adjustment screw with which a position of the plug-in slot is adjustable in a direction normal to the slot.

8. The lifting hardware according to claim 1, further comprising:

a column on which the support frame is mounted, the column having a guide profile that extends along the column, the drive adapted to vertically adjust the support frame by extending the column, and a holder that is arranged in a fixed position, with the guide profile guided in the holder.

* * * * *